US010041515B2

(12) United States Patent
Fu

(10) Patent No.: US 10,041,515 B2
(45) Date of Patent: Aug. 7, 2018

(54) REDUCING NOISE DOUBLE-CHANNEL OIL PUMP

(71) Applicant: Jiashan Handijack Tools CORP, Jiaxing (CN)

(72) Inventor: Yonggang Fu, Jiaxing (CN)

(73) Assignee: JIASHAN HANDIJACK TOOLS CORP, Jiaxing (CN)

( * ) Notice: Subject to any disclaimer, the term of this patent is extended or adjusted under 35 U.S.C. 154(b) by 212 days.

(21) Appl. No.: 15/072,376

(22) Filed: Mar. 17, 2016

(65) Prior Publication Data

US 2017/0218985 A1 Aug. 3, 2017

(30) Foreign Application Priority Data

Feb. 3, 2016 (CN) ..... 2016 1 0076846

(51) Int. Cl.

| | |
|---|---|
| ***F04B 23/04*** | (2006.01) |
| ***F15B 21/00*** | (2006.01) |
| ***F15B 15/20*** | (2006.01) |
| ***F04B 49/24*** | (2006.01) |
| ***F04B 53/00*** | (2006.01) |
| ***F04B 53/10*** | (2006.01) |
| ***F04B 53/16*** | (2006.01) |

(52) U.S. Cl.

CPC ..... *F15B 21/008* (2013.01); *F04B 23/04* (2013.01); *F04B 49/24* (2013.01); *F04B 53/001* (2013.01); *F04B 53/10* (2013.01); *F04B 53/1002* (2013.01); *F04B 53/16* (2013.01); *F15B 15/20* (2013.01); *F15B 2211/30505* (2013.01); *F15B 2211/329* (2013.01); *F15B 2211/50536* (2013.01); *F15B 2211/8616* (2013.01)

(58) Field of Classification Search

CPC .... F15B 15/20; F15B 15/2807; F15B 21/008; F15B 11/17; F15B 2211/20584; F15B 2211/20592; F04B 53/001; F04B 23/04; F04B 53/10; F04B 53/1002; F04B 53/16; F04B 49/24; B63H 20/10

See application file for complete search history.

(56) References Cited

U.S. PATENT DOCUMENTS

| | | | | |
|---|---|---|---|---|
| 3,903,698 A * | 9/1975 | Gellatly | F16H 39/02 | 60/453 |
| 6,886,332 B2 * | 5/2005 | Kubinski | F15B 7/006 | 60/475 |
| 2006/0037647 A1 * | 2/2006 | Okuda | F16K 15/025 | 137/543.23 |

* cited by examiner

*Primary Examiner* — Michael Leslie
*Assistant Examiner* — Abiy Teka
(74) *Attorney, Agent, or Firm* — Hemisphere Law, PLLC; Zhigang Ma

(57) ABSTRACT

The present disclosure discloses a reducing noise double-channel oil pump including a pump body. The pump body connects an oil box and an actuator. Parallel distributed a small and a big flow oil channels are located between the oil box and the actuator. The small flow oil channel connects a first twin pump and first one-way valves. The big flow oil channel connects a second twin pump and second one-way valves. The pump body also disposes a reducing noise oil channel. A connection of the reducing noise oil channel and the big flow oil channel locates a one-way controlled valve. Another end of the reducing noise oil channel connects an oil pressure feedback oil way. A connection of the reducing noise oil channel and the oil pressure feedback oil way locates an oil pressure driving mechanism. The middle of the reducing noise oil channel connects an unloading oil way.

10 Claims, 5 Drawing Sheets

REDUCING NOISE DOUBLE-CHANNEL OIL PUMP

This application claims the priority of Chinese patent application number 201610076846.2, filed on Feb. 3, 2016, the entire contents of which are incorporated herein by reference.

FIELD OF THE DISCLOSURE

The present disclosure relates to mechanical dynamic technologies, and particularly, to a reducing noise double-channel oil pump.

BACKGROUND OF THE DISCLOSURE

An oil pump is a dynamic component, which uses actions of oil pressure thereby realizing dynamic output. It is usually used to be applied in a kind of dismantling tools of automobiles.

For example, Chinese patent discloses a twin pump single cylinder rapid supercharge horizontal jack, with application number 201420604540.6, includes a pedestal, a pressure arm, filling pumps, an oil cylinder being push rod piston, a valve body; the pressure arm is installed on the pedestal, the pressure arm connects to a handle, the pedestal is located on two filling pumps, one end of two filling pumps are parallel and respectively through oil channels to connect with a hydraulic cylinder, the another ends are connected with the pressure arm; a lifting arm is mounted on the pedestal, one end of the lifting arm body through a connector joins with the top head of the oil cylinder, the other end is connected to a tray, the tray bottom is connected with a link rod, the other end of the link rod is fixed on the pedestal; an underpart of the pedestal is fastened to roll wheels. The present scheme is a kind of horizontal jack, which uses the two filling pumps for rapidly supercharging to rise substances, quickly reaching to the top level, its bottom is mounted with wheels, moves conveniently, saves power high efficiency; the handle uses telescopic laminar multi-section handle, is folding, the whole machine is easily carried.

The above-mentioned scheme although has above-mentioned many advantages, the scheme at least has below shortcomings: the filling oil pumps in the loading conditions (when intermittent motion and high flow speed), its inner low press overflow valve owing oil pressure every time gradually rising to cause the valve every time gradually being started, and the low press overflow valve every time in the starting process, there is all to generate larger noise when a hydraulic oil flows through the low press overflow valve, the practicality is bad.

SUMMARY OF THE DISCLOSURE

An object of the pressure disclosure is aimed at the above questions, to provide a reducing noise double-channel oil pump, which is designed more reasonable, can greatly reduce noise.

In order to achieve the above object, the present disclosure adopts the following technique scheme: the reducing noise double-channel oil pump includes a pump body, the pump body connects an oil box and an actuator, a small flow oil channel and a big flow oil channel parallel arranged and disposed between the oil box and the actuator, a first twin pump and first one-way valves located on both sides of the first twin pump connected on the small flow oil channel, an overflow structure located between the two one-way valves, a second twin pump and second one-way valves located on both sides of the second twin pump located on the big flow oil channel, a reducing noise oil channel with one end connecting to the big flow oil channel also disposed on the pump body, a one-way controlled valve which can make the reducing noise oil channel lead to the big flow oil channel, located on a connection of the reducing noise oil channel and the big flow oil channel; an oil pressure feedback oil way which can make an oil pressure work in the reducing noise oil channel after oil orderly passes through two second one-way valves, connected to the other end of the reducing noise oil channel; an oil pressure driving mechanism, which can move towards the one-way valve and impel the one-way valve to be opened, when an oil pressure of the oil flowing from the oil pressure feedback oil way into the reducing noise oil channel is larger than a setting pressure and under acting of the oil pressure, located on a connection of the reducing noise oil channel and the oil pressure feedback oil way; an unloading oil way which can make the oil flew from the big flow oil channel into the reducing noise oil channel drain into the oil box, connected to the middle part of the reducing noise oil channel.

In the present application, because it sets up a structure of that the small flow oil channel and the big flow oil channel are combined with the reducing noise oil channel, one-way valves and the oil pressure driving mechanism, can greatly decrease noise generated when a hydraulic oil pumped out in a big flow overflows the oil box. The oil pressure feedback oil way can improve stability in use process, ensure that in loading condition it is capable of feeding back oil pressure without delay, ensure system is safety in use, designs more reasonable and more utility, corresponds to the development trend of the current society technology.

In the said reducing noise double-channel oil pump, one end of the reducing noise oil channel connected with the big flow oil channel disposes a first hole expansion, the first hole expansion outer orifice sets a first seaming structure; one end of the reducing noise oil channel connected the oil pressure feedback oil disposes a second hole expansion, the second hole expansion outer orifice sets a second seaming structure.

In the said reducing noise double-channel oil pump, the one-way valve includes a spherical body which is located in the first hole expansion and its diameter is larger than the internal diameter of the reducing noise oil channel, a spring is located between the spherical body and the first seaming structure, which can impel the spherical body to plug a connection of the reducing noise oil channel and the first hole expansion, the big flow oil channel and the first hole expansion are connected.

In the said reducing noise double-channel oil pump, the oil pressure driving mechanism includes a driving rod which is inserted in the reducing noise oil channel and the front end is capable of stretching into in the second hole expansion, the back end of the driving rod and the second hole expansion therebetween are disposed a spacing structure, which is used for preventing the driving rod from over stretching into the second hole expansion and is capable of dividing the second hole expansion into a first chamber and a second chamber, the oil pressure feedback oil way and the second chamber are connected.

In said reducing noise double-channel oil pump, the spacing structure includes an annular convex part which is connected on the back end of the driving rod and located in the second hole expansion, the reducing noise oil channel and the second hole expansion therebetween is formed an obstruction surface, an external diameter of the annular convex part is larger than an internal diameter of the reducing noise oil channel and when the annular convex part supports against on the obstruction surface the driving rod stops moving.

In the said reducing noise double-channel oil pump, an external diameter of the driving rod is smaller than the internal diameter of the reducing noise oil channel, the annular convex part and a wall of the second hole expansion therebetween is hermetically connected.

In the said reducing noise double-channel oil pump, the surrounding of the annular convex part is located an annular positioning groove and an O shape seal ring deposed in the annular positioning groove and hermetically connected with the wall of the second hole expansion.

In the said reducing noise double-channel oil pump, one end of the annular convex part away from the driving rod is located a positioning pillar, an external diameter of the positioning pillar is smaller than a diameter of the second hole expansion.

In the said reducing noise double-channel oil pump, the internal diameter of the reducing noise oil channel is larger than an internal diameter of the big flow oil channel, an internal diameter of the oil pressure feedback oil way is smaller than the internal diameter of the reducing noise oil channel. Of course, sizes of the internal diameters can be set according to the actual use demand. Also can be equal to internal diameters.

In the said reducing noise double-channel oil pump, one end of the small flow oil channel connected with the oil box is joined a first filter net, one end of the big flow oil channel connected with the oil box is joined a second filter net.

In the said reducing noise double-channel oil pump, the actuator is connected with an overall oil channel, the small flow oil channel and the big flow oil channel are respectively connected with the overall oil channel, the overall oil channel thereon is still connected an unloading structure.

Comparing with the prior art, advantages of the reducing noise double-channel oil pump are in:

Firstly, because it sets up a structure of that the small flow oil channel and the big flow oil channel are combined with the reducing noise oil channel, one-way valves and the oil pressure driving mechanism, can greatly decrease noise generated when a hydraulic oil pumped out in a big flow overflows the oil box. The oil pressure feedback oil way can improve stability in use process, ensure that in loading condition it is capable of feeding back oil pressure without delay, ensure system is safety in use, designs more reasonable and more utility, corresponds to the development trend of the current society technology.

Secondly, the structure is simple and easy to manufacture, using life span is long.

BRIEF DESCRIPTION OF THE DRAWINGS

In order to illustrate technical schemes of the present disclosure or the prior art more clearly, the following section briefly introduces drawings used to describe the embodiments and prior art. Obviously, the drawing in the following descriptions just is some embodiments of the present disclosure. The ordinary person in the related art can acquire the other drawings according to these drawings without offering creative effort.

Figure 1:
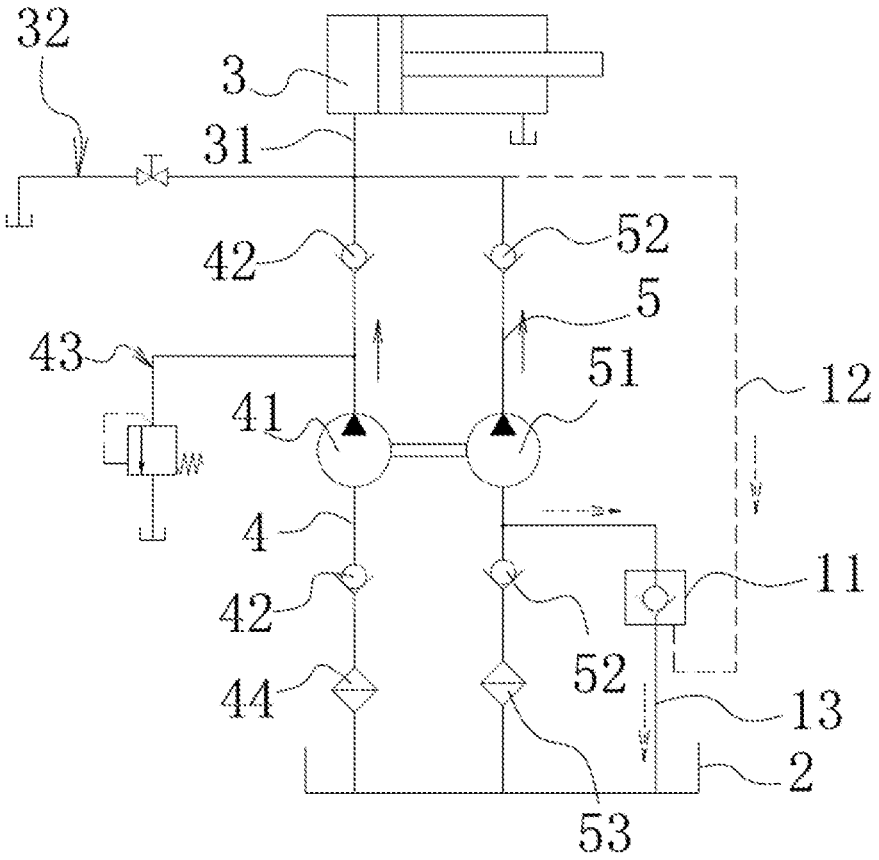
FIG. 1 is a theory structural schematic view of the present disclosure.

In drawings, pump body 1,
third hole expansion 1*a*,
first seaming head 1*b*,
first seal ring 1*c*,
fourth hole expansion 1*d*,
second seaming head 1*e*,
second seal ring 1*f*,
reducing noise oil channel 11,
first hole expansion 11*a*,
second hole expansion 11*b*,
obstruction surface 11*c*,
oil pressure feedback oil way 12,
unloading oil way 13,
oil box 2,
actuator 3,
overall oil channel 31,
unloading structure 32,
small flow oil channel 4,
first twin-pump 41,
first one-way valve 42,
overflow structure 43,
first filter net 44,
big flow oil channel 5,
second twin-pump 51,
second one-way valve 52,
second filter net 53,
one-way controlled valve 6,
spherical body 61,
spring 62,
oil pressure driving mechanism 7,
driving rod 71,
annular convex part 72,
positioning pillar 73,
first chamber a,
second chamber b.

DETAILED DESCRIPTION OF ILLUSTRATED EMBODIMENTS

The following sections offer a clear, complete description of the present disclosure in combination with the embodiments and accompanying drawings. Obviously, the embodiments described herein are only a part of, but not all of the embodiments of the present disclosure. In view of the embodiments described herein, any other embodiment obtained by the person skilled in the field without offering creative effort is included in a scope claimed by the present disclosure.

Figure 2:
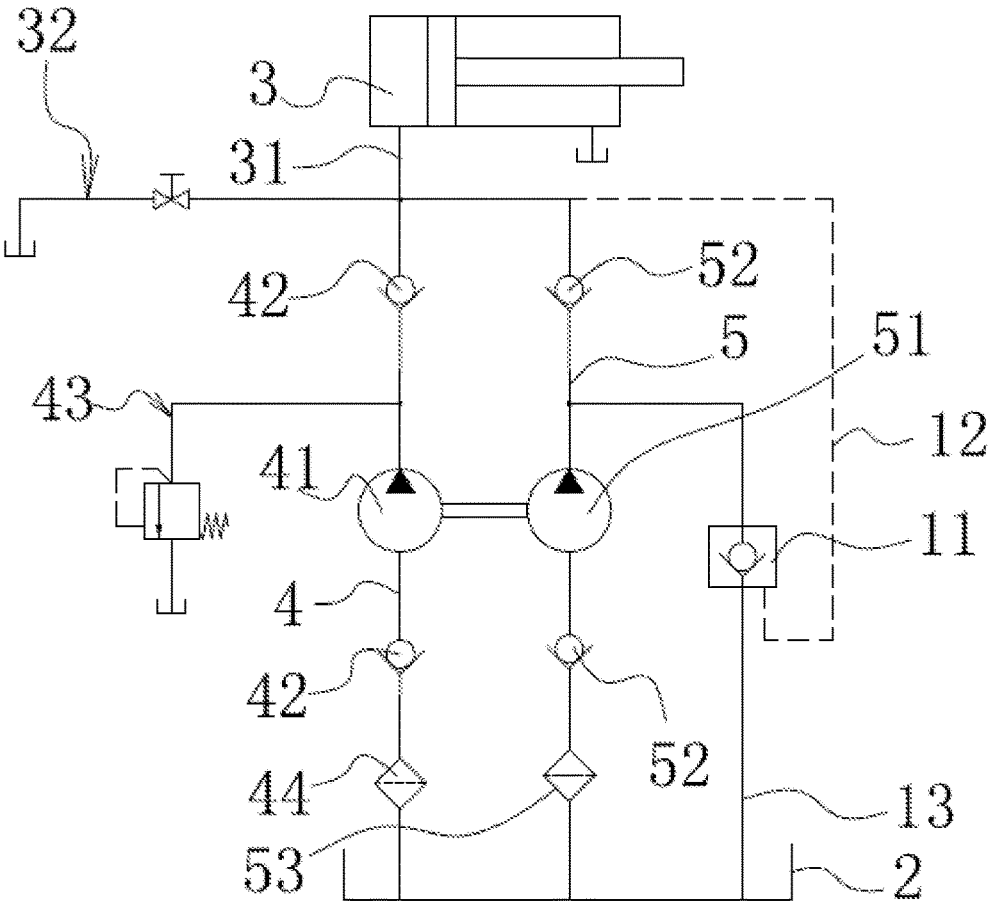
FIG. 2 is a second kind of theory structural schematic view of the present disclosure.

Referring to FIGS. 1-2, the reducing noise double-channel oil pump includes a pump body 1, the pump body 1 is connected with an oil box 2 and an actuator 3, the actuator 3 is an oil hydro-cylinder. The oil box 2 and the actuator 3 therebetween are disposed parallel arranged a small flow oil channel 4 and a big flow oil channel 5, the overall oil channel 31 is joined with the actuator 3, the small flow oil channel 4 and the big flow oil channel 5 are respectively connected with the overall oil channel 31, on the overall oil channel 31 are still connected an unloading structure 32.

Detailedly, the unloading structure 32 includes an unloading oil way, the unloading oil way thereon is connected an unloading valve.

The small flow oil channel 4 thereon is connected a first twin pump 41 and first one-way valves 42 located on two sides of the first twin pump 41, one end of the small flow oil channel 4 away from the oil box 2 thereon is connected a first filter net 44. An oil gone out from the oil box 42 orderly flows through the first filter net 44, one of the two first one-way valves 42, the first twin pump 41 and the other one of the two first one-way valves 42, finally flows into the actuator 3. Wherein, between the two one-way valves 42 there are connected an overflow structure 43, specifically, the overflow structure 43 of the present embodiment includes an overflow pipe connected on the small flow oil channel 4, an overflow valve is connected the overflow pipe.

On the big flow oil channel 5 there is located a second twin pump 51 and second one-way valves 52 located on two sides of the second twin pump 51, one end of the big flow oil channel 5 away from the oil box 2 thereon is connected a second filter net 53. An oil gone out from the oil box 42 orderly flows through the second filter net 53, one of the two second one-way valves 52, the second twin pump 51 and the other one of the two second one-way valves 52, finally flows into the actuator 3.

Referring to FIGS. 1-4, on the pump body 1 there is still disposed a reducing noise oil channel 11 with one end connected with the big flow oil channel 5, an internal diameter of the reducing noise oil channel 11 is larger than an internal diameter of the big flow oil channel 5, on a connection of the reducing noise oil channel 11 and the big flow oil channel 5 there is located a one-way controlled valve 6, another end of the reducing noise oil channel 11 is connected with an oil pressure feedback oil way 12, which can make oil pressure act in the reducing noise oil channel 11 after oil orderly goes through the two first one-way valves 42; an internal diameter of the oil pressure feedback oil way 12 is smaller than the internal diameter of the reducing noise oil channel 11. On a connection of the reducing noise oil channel 11 and the oil pressure feedback oil way 12 there is connected with an oil pressure driving mechanism 7, which can move towards the one-way controlled valve 6 and impel the one-way controlled valve 6 to be opened, when an oil pressure of oil, that is from the oil pressure feedback oil way 12 flew into the reducing noise oil channel 11, is larger than a predetermined oil pressure; the middle of the reducing noise oil channel 11 there is connected with an unloading oil way 13, which can make oil from the big flow oil channel 5 flowing into the reducing noise oil channel 11 is drained into the oil box 2, after the one-way controlled valve 6 is opened. The big flow oil channel 5 is a high pressure oil channel, its inner oil pressure is higher, through a structure that the oil pressure feedback oil way 5 combines with the one-way controlled valve 6 and the oil pressure driving mechanism 7, solves a technical question that every time action can greatly decrease high unloading noise.

Figure 3:
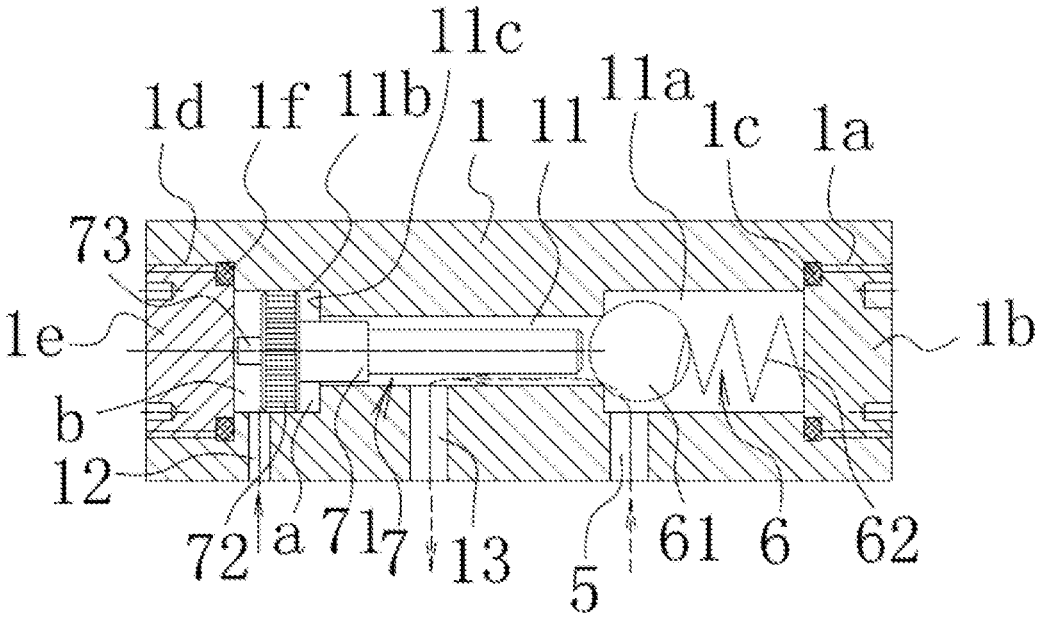
FIG. 3 is a part sectioned structural schematic view of the present disclosure.
Figure 4:
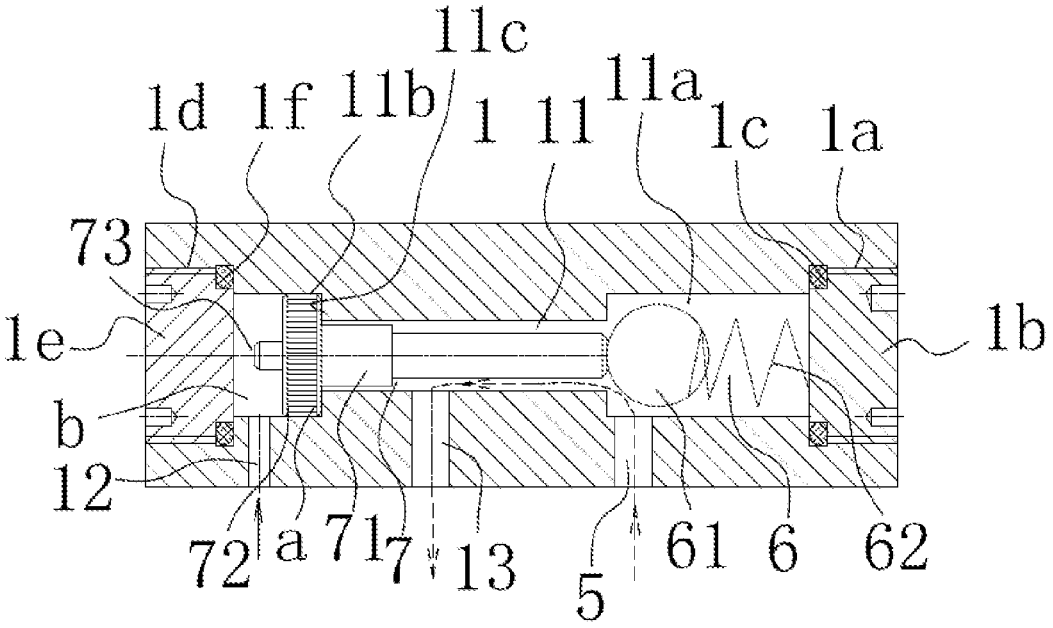
FIG. 4 is a structural schematic view of the present disclosure in open condition.

In preferred scheme, referring to FIGS. 3-4, on one end of the reducing noise oil channel 11 connected with the big flow oil channel 5 there is disposed a first hole expansion 11*a*, on an outer orifice of the first hole expansion 11*a* is set a first seaming structure; specifically, the first seaming structure of the present embodiment includes a third hole expansion 1*a* connected with the first hole expansion 11*a*, in the third hole expansion 1*a* disposed a first seaming head 1*b* screwed joint with the third hole expansion 1*a*, a first seal ring 1*c* located between the first seaming head 1*b* and the hole bottom of the third hole expansion 1*a*. Next, on one end of the reducing noise oil channel 11 joined with the oil pressure feedback oil way 12 is disposed a second hole expansion 11*b*, on the outer orifice of the second hole expansion 11*b* is set a second seaming structure. Detailedly, the second seaming structure of the present embodiment includes a fourth hole expansion 1*d* connected with the second hole expansion 11*ba*, in the fourth hole expansion 1*d* disposed a second seaming head 1*e* screwed joint with the fourth hole expansion 1*d*, a second seal ring 1*f* located between the second seaming head 1*e* and an inner end of the fourth hole expansion 1*d*. It realizes seal through the seaming structures.

Specifically, referring to FIGS. 3-4, the one-way valve 6 of the present embodiment includes a spherical body 61 which is located in the first hole expansion 11*a* and its diameter is larger than the internal diameter of the reducing noise oil channel 11, the spherical body 61 is made of a metal or a non-metal material. The non-metal includes ceramic material. The spherical body 61 and the first seaming structure therebetween is spring 62, which can impel the spherical body 61 to plug the connection of the reducing noise oil channel 11 and the first hole expansion 11*a*, the big flow oil channel 5 and the first hole expansion 11*a* are connected. One end of the spring 62 acts on the spherical body 61, the other end acts on an internal side flat surface of the first seaming head 1*b*.

Next, referring to FIGS. 3-4, the oil pressure driving mechanism 7 includes a driving rod 71 which is inserted in the reducing noise oil channel 11 and its front end is capable of stretching into in the second hole expansion 11*b*, the driving rod 71 is a stepped rod structure, between the back end of the driving rod 71 and the second hole expansion 11*b* where is disposed a spacing structure, which is used for preventing the driving rod 71 from over stretching into the second hole expansion 11*b* and is capable of dividing the second hole expansion 11*b* into a first chamber a and a second chamber b, the oil pressure feedback oil way 12 and the second chamber b are connected.

Further, the spacing structure includes an annular convex part 72 which is joined on the back end of the driving rod 71 and located in the second hole expansion 11*b*, an external diameter of the driving rod 71 is smaller than the internal diameter of the reducing noise oil channel 11, the annular convex part 72 and the wall of the second hole expansion 11*b* therebetween are formed an obstruction surface 11*c*, an external diameter of the annular convex part 72 is larger than the internal diameter of the reducing noise oil channel 11 and when the annular convex part 72 supports against the obstruction surface 11*c*, the driving rod 71 stops moving. Next, the surrounding of the annular convex part 72 is located an annular positioning groove and an O shape seal ring 72*a* disposed in the annular positioning groove and hermetically connected with the wall of the second hole expansion 11*b*.

In preferred scheme, one end of the annular convex part 72 away from the driving rod 71 is located a positioning pillar 73, an external diameter of the positioning pillar 73 is smaller than the diameter of the second hole expansion 11*b*. A function of the positioning pillar 73 can avoid excessively moving towards back thereby increasing moving stroke.

Figure 5:
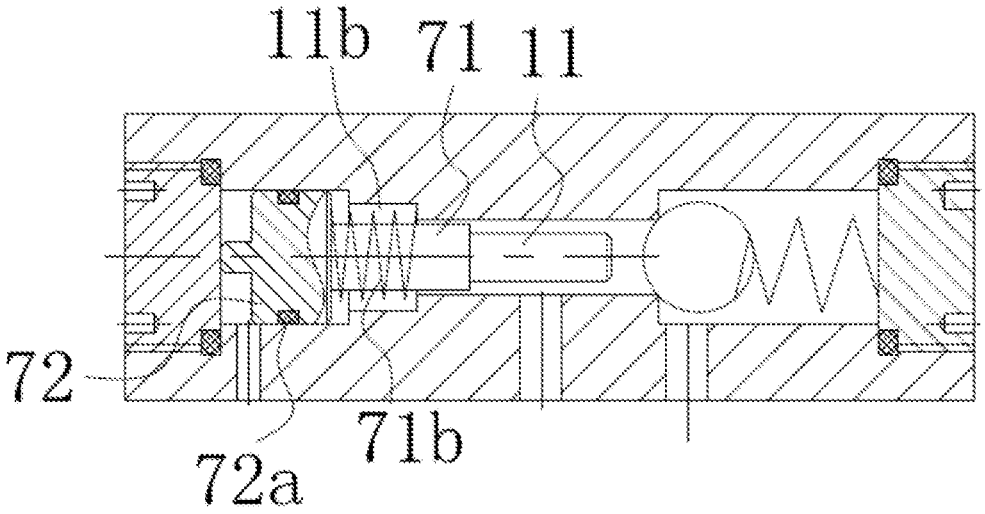
FIG. 5 is a preferred structural schematic view of the present disclosure.

In addition, referring to FIG. 5, the driving rod 71 is harnessed a dynamic seal structure joined with the wall of the second hole expansion 11*b*. The dynamic seal structure includes an annular groove located on the driving rod 71 and a seal ring located in the annular groove. Next, a restoring structure is disposed between the front end of the driving rod 71 and the bottom of the second hole expansion 11*b*. The restoring structure includes a restoring spring 71*b* harnessed on the front end of the driving rod 71, one end of the restoring spring 71*b* is act on the blocking part in the middle of the driving rod 71, the other end is act on the obstruction surface 11*c*, can change different elastic springs according to a pressure fed back from the oil pressure feedback oil channel 12, next, the restoring spring 71*b* also acts as multiple functions of guide and buffer, can improve ride comfort when the driving rod 71 moves, buffer can ensure that it generates noise while bursting through the spherical body. An inner of the pump body of the present embodiment is set a pump core. An action of the restoring spring 71*b* can further improve reliability of every acting, secondly, the restoring spring 71*b* also acts as buffer, avoids to generating unnecessary noise when the driving rod 71 rams the spherical body.

A working theory of the present embodiment is shown as below: Firstly, when pump body works, owing to moving back and forth of the pump core, absorb oil from the oil box, and inject oil into the actuator 3, complete the work.

Secondly, controlling the work of the driving rod 71, makes the big flow pump core being out of action when load is excessive.

Thirdly, the load is small, the pressure fed back from oil pump is small, the spherical body is supported against pump body valve surface under acting of the spring, in a seal condition, the pump core normally works.

Fourthly, the load is big, the pressure fed back from oil pump is large, the driving rod 71 is pressed down under the function of oil pressure, and burst through the spherical body, at the moment, a valve body being in connected condition, the oil in the big flow oil channel 5 directly flows into the reducing noise oil channel and back to the oil box through the unloading oil way 13, at the same time, the pump core is out of action.

The present embodiment can be applied in any one kind of a horizontal jack, a lifting jack and an oil pressure lift platform.

What is said above are only preferred examples of present disclosure, not intended to limit the present disclosure, any modifications, equivalent substitutions and improvements etc. made within the spirit and principle of the present disclosure, should be included in the protection range of the present disclosure.

Though pump body 1, third hole expansion 1*a*, first seaming head 1*b*, first seal ring 1*c*, forth hole expansion 1*d*, second seaming head 1*e*, second seal ring 1*f*, reducing noise oil channel 11, first hole expansion 11*a*, second hole expansion 11*b*, obstruction surface 11*c*, oil pressure feedback oil way 12, unloading oil way 13, oil box 2, actuator 3, overall oil channel 31, unloading structure 32, small flow oil channel 4, first twin-pump 41, first one-way valve 42, overflow structure 43, first filter net 44, big flow oil channel 5, second twin-pump 51, second one-way valve 52, second filter net 53, one-way controlled valve 6, spherical body 61, spring 62, oil pressure driving mechanism 7, driving rod 71, annular convex part 72, positioning pillar 73, first chamber a, second chamber b and so on terms being used in the present text, it doesn't exclude the possibility of using other terms. The terms are used only to more conveniently describe and explain the spirit of the present disclosure; it all violates the spirit of the present disclosure to explain them into any additional limitations.

What is claimed is:

1. A reducing noise double-channel oil pump comprising a valve body, on the valve body connected an oil box and an actuator, wherein, parallel arranged a small flow oil channel and a big flow oil channel disposed between the oil box and the actuator, a first twin pump and two first one-way valves located on both sides of the first twin pump connected on the small flow oil channel, an overflow structure located between the two first one-way valves, a second twin pump and two second one-way valves located on both sides of the second twin pump located on the big flow oil channel, a reducing noise oil channel with one end connected to the big flow oil channel also disposed on the valve body, a one-way controlled valve which can make the reducing noise oil channel lead to the big flow oil channel, located on a connection of the reducing noise oil channel and the big flow oil channel; an oil pressure feedback oil way which can make an oil pressure work in the reducing noise oil channel after oil orderly passes through the two second one-way valves, connected to the other end of the reducing noise oil channel; an oil pressure driving mechanism comprising a driving rod, which can move towards the controlled one-way valve and impel the controlled one-way valve to be opened, when an oil pressure of the oil flowing from the oil pressure feedback oil way into the reducing noise oil channel is larger than a setting pressure and the oil pressure driving mechanism is under acting of the oil pressure, located on a connection of the reducing noise oil channel and the oil pressure feedback oil way; an unloading oil way which can make the oil flew from the big flow oil channel into the reducing noise oil channel drain into the oil box, connected to a middle part of the reducing noise oil channel.

2. The reducing noise double-channel oil pump of claim 1, wherein the end of the reducing noise oil channel connected to the big flow oil channel is disposed in a first hole expansion, a first seaming structure is located on an outer orifice of the first hole expansion; a second hole expansion is disposed on an other end of the reducing noise oil channel connected the oil pressure feedback oil way, a second seaming structure is located on an outer orifice of the second hole expansion.

3. The reducing noise double-channel oil pump of claim 2, wherein the controlled one-way valve comprises a spherical body which is located in the first hole expansion and its diameter is larger than an internal diameter of the reducing noise oil channel, a spring which can impel the spherical body to plug a connection of the reducing noise oil channel and the first hole expansion, is located between the spherical body and the first seaming structure, wherein the big flow oil channel and the first hole expansion are connected.

4. The reducing noise double-channel oil pump of claim 3, wherein the oil pressure driving mechanism comprises the driving rod which is inserted in the reducing noise oil channel and a front end is capable of stretching into in the second hole expansion, a spacing structure which is used for preventing the driving rod over stretching into the second hole expansion and being capable of dividing the second hole expansion into a first chamber and a second chamber, is located between a back end of the driving rod and the second hole expansion, wherein the oil pressure feedback oil way and the second chamber are connected.

5. The reducing noise double-channel oil pump of claim 4, wherein the spacing structure comprises an annular convex part which is connected on the back end of the driving rod and located in the second hole expansion, an obstruction surface is formed between the reducing noise oil channel and the second hole expansion, an external diameter of the annular convex part is larger than the internal diameter of the reducing noise oil channel and when the annular convex part supports against the obstruction surface, the driving rod stops moving.

6. The reducing noise double-channel oil pump of claim 5, wherein an external diameter of the driving rod is smaller than the internal diameter of the reducing noise oil channel, the annular convex part and a wall of the second hole expansion are hermetically connected.

7. The reducing noise double-channel oil pump of claim 6, wherein one end of the annular convex part away from the driving rod is connected to a positioning pillar, an external diameter of the positioning pillar is smaller than a diameter of the second hole expansion.

8. The reducing noise double-channel oil pump of claim 6, wherein surrounding the annular convex part is located an annular positioning groove; wherein an O shape seal ring is deposed in the annular positioning groove and hermetically connected to the wall of the second hole expansion.

9. The reducing noise double-channel oil pump of claim 1, wherein one end of the small flow oil channel is connected to the oil box which is joined to a first filter net, wherein one end of the big flow oil channel is connected to the oil box which is joined to a second filter net.

10. The reducing noise double-channel oil pump of claim 1, wherein the actuator is connected with an overall oil channel, the small flow oil channel and the big flow oil channel are respectively connected with the overall oil channel, the overall oil channel is still connected to an unloading structure.

* * * * *